United States Patent [19]

Chujo et al.

[11] Patent Number: 4,836,174

[45] Date of Patent: Jun. 6, 1989

[54] ENGINE CONTROL SYSTEM

[75] Inventors: Yoshiki Chujo; Tokuta Inoue, both of Mishima; Toshiaki Konomi; Yoshihiko Hyodo, both of Susono, all of Japan

[73] Assignee: Toyota Jidosha Kabushiki Kaisha, Aichi, Japan

[21] Appl. No.: 151,576

[22] Filed: Feb. 2, 1988

[30] Foreign Application Priority Data

Feb. 6, 1987 [JP] Japan ..... 62-24825
Feb. 6, 1987 [JP] Japan ..... 62-24826

[51] Int. Cl.[4] ..... F02M 25/06
[52] U.S. Cl. ..... 123/571
[58] Field of Search ..... 123/440, 486, 489, 494, 123/568, 569, 571; 60/276, 278

[56] References Cited

U.S. PATENT DOCUMENTS

| | | | |
|---|---|---|---|
| 4,005,689 | 2/1977 | Barnard | 60/278 X |
| 4,108,122 | 8/1978 | Barnard | 60/276 X |
| 4,614,175 | 9/1986 | Asayama | 123/571 |
| 4,697,564 | 10/1987 | Ohgami et al. | 123/489 X |
| 4,705,009 | 11/1987 | Asayama | 123/571 |
| 4,707,241 | 11/1987 | Nakagawa et al. | 123/489 X |

FOREIGN PATENT DOCUMENTS

| | | |
|---|---|---|
| 0075548 | 6/1980 | Japan . |
| 0247839 | 11/1986 | Japan . |

*Primary Examiner*—Willis R. Wolfe
*Attorney, Agent, or Firm*—Kenyon & Kenyon

[57] ABSTRACT

An engine control system having an oxygen density sensor arranged in an intake system at a position downstream of a throttle valve for detecting the amount of air newly introduced into the engine. The sensor is a limit electric current detection type capable of detecting a continuously changing density of oxygen. An amount of fuel to be injected is calculated in accordance with the output level of the sensor by using mapped data of the output level of the sensor signal. The sensitivity of the sensor is detected and multiplied by the output value of the sensor for obtaining a precise oxygen partial pressure. Instead of calculating the basic fuel amount from the output level of the oxygen density sensor, a normal intake pressure sensor with an intake pressure-engine speed map can be employed. In the latter case, the oxygen partial pressure from the oxygen density sensor is used for correcting the calculated basic fuel amount. The sensitivity of the sensor is also corrected.

8 Claims, 9 Drawing Sheets

Fig. 7(a) CRANK ANGLE

Fig. 7(b) INJECTION CALCULATION

Fig. 7(c) INJECTION SIGNAL

ENGINE CONTROL SYSTEM

BACKGROUND OF THE INVENTION

1. Field of the Invention

The present invention relates to an engine control system for controlling an engine operating condition such as a fuel injection amount or an ignition timing.

2. Description of the Related Art

Known in the prior art is a D-J type fuel injection system for an internal combustion engine, wherein an intake pressure sensor is arranged in an intake line of the engine at a position downstream from a throttle valve to detect an intake pressure as a parameter of an engine load. The detection of the intake pressure and of an engine speed enables the detection of an amount of intake air fed into the cylinder bore. A fuel injection amount is determined by the detected intake air amount so as to maintain a designated air-fuel ratio value and this amount of fuel is injected by the fuel injector. This D-J type fuel injection system is advantageous in that it makes it possible to mount a smaller sensor and thus reduce the air flow resistance, compared with the L-J type fuel injection system wherein a relatively large air flow meter is arranged in the intake passage for detecting the intake air amount.

Contrary to the L-J type fuel injection system, this D-J type fuel injection system detects an amount of air introduced into the engine indirectly, from the value of the intake pressure. This means that the output level of the sensor has the same value even when the amount of newly introduced air is changed under certain conditions, for example, where only air is introduced into the engine and where a gas, for example, exhaust gas, other than the air is introduced into the engine. Therefore, when an exhaust gas re-circulation operation is carried out, it is necessary to compensate the detected output value of the sensor in order to obtain a correct value of the amount of new air introduced into the engine, if the map is appropriate for an EGR operation. To accomplish this, a system is disclosed in Japanese Unexamined Patent Publication No. 55-75548 wherein a fixed dimension orifice is arranged in an exhaust gas re-circulation passageway, and a pressure sensor is arranged to detect a pressure drop across the orifice. This detected pressure drop is utilized for correcting the output value of the intake pressure sensor, and thus obtain a precise value of the amount of newly introduced air.

This improved system has a drawback, however, in that the precise amount of new air cannot be detected, since it is not possible to directly detect the amount of new air. This has a drawback in that a quick control of the target air-fuel ratio cannot be achieved during a transient state of the engine.

SUMMARY OF THE INVENTION

An object of the present invention is to provide a system capable of attaining a precise control of an engine characteristic as desired while maintaining the above-mentioned advantage of the D-J type fuel injection system.

Another object of the present invention is to provide a system capable of attaining a precise control of the engine characteristic by compensating a change in a sensor characteristic induced by individual differences or prolonged use.

According to one aspect of the present invention, an internal combustion engine is provided which comprises:

an engine body;

an intake system connected to the engine body for an introduction of air thereto, the system including a throttle valve for controlling the amount of air introduced;

an exhaust system connected to the engine body for a removal of resultant combustion gas therefrom;

calculating means for calculating a basic value of an engine characteristic concerning an amount of new air introduced into the engine, to obtain a predetermined value of said engine characteristic as desired;

sensor means arranged in the intake system at a position downstream of the throttle valve, said sensor means being responsive to a partial pressure of oxygen in the introduced new air and providing an electric signal indicating the amount of new air introduced;

correcting means, responsive to the sensed value of the partial pressure of oxygen in the introduced new air, for obtaining a corrected basic value of an engine operational characteristic to attain a precise control of the engine characteristic to a desired value, and;

control means, responsive to the calculated engine operating characteristic value, for controlling the engine operational characteristic.

According to another aspect of the present invention, an internal combustion engine is provided which comprises:

an engine body;

an intake system connected to the engine body for an introduction of air thereto, the system including a throttle valve for controlling the amount of air introduced;

an exhaust system connected to the engine body for a removal of resultant combustion gas therefrom;

sensor means arranged in the intake system at a position downstream of the throttle valve, said sensor means being responsive to the partial pressure of oxygen in the introduced new air and providing an electric signal indicating the amount of new air introduced;

means for correcting the sensitivity of the sensor means;

calculating means, responsive to the sensed amount of new air introduced, for calculating the value of an engine operational characteristic to be controlled by the introduced new air;

control means, responsive to the calculated engine operating characteristic value, for controlling the engine operational characteristic.

According to a further aspect of the present invention, an internal combustion engine is provided which comprises:

an engine body;

an intake system connected to the engine body for an introduction of air thereto, the system including a throttle valve for controlling the amount of air introduced;

an exhaust system connected to the engine body for a removal of resultant combustion gas therefrom;

first sensor means arranged in the intake system at a position downstream of the throttle valve for detecting an intake pressure;

calculating means for calculating, from the detected intake pressure, a basic value of an engine characteristic concerning an amount of new air introduced into the engine, to obtain a predetermined value of said engine characteristic as desired;

second sensor means being arranged in the intake system at a position downstream of the throttle valve, and being responsive to the partial pressure of oxygen in the introduced new air for providing an electric signal indicating of the amount of air introduced;

correcting means, responsive to the sensed value of the partial pressure of oxygen in the introduced air, for obtaining a corrected basic value of an engine operational characteristic to attain a precise control of the engine characteristic to the desired value, and;

control means responsive to the calculated engine operating characteristic value, for controlling the engine operational characteristic.

DESCRIPTION OF THE PREFERRED EMBODIMENTS

Figure 1:
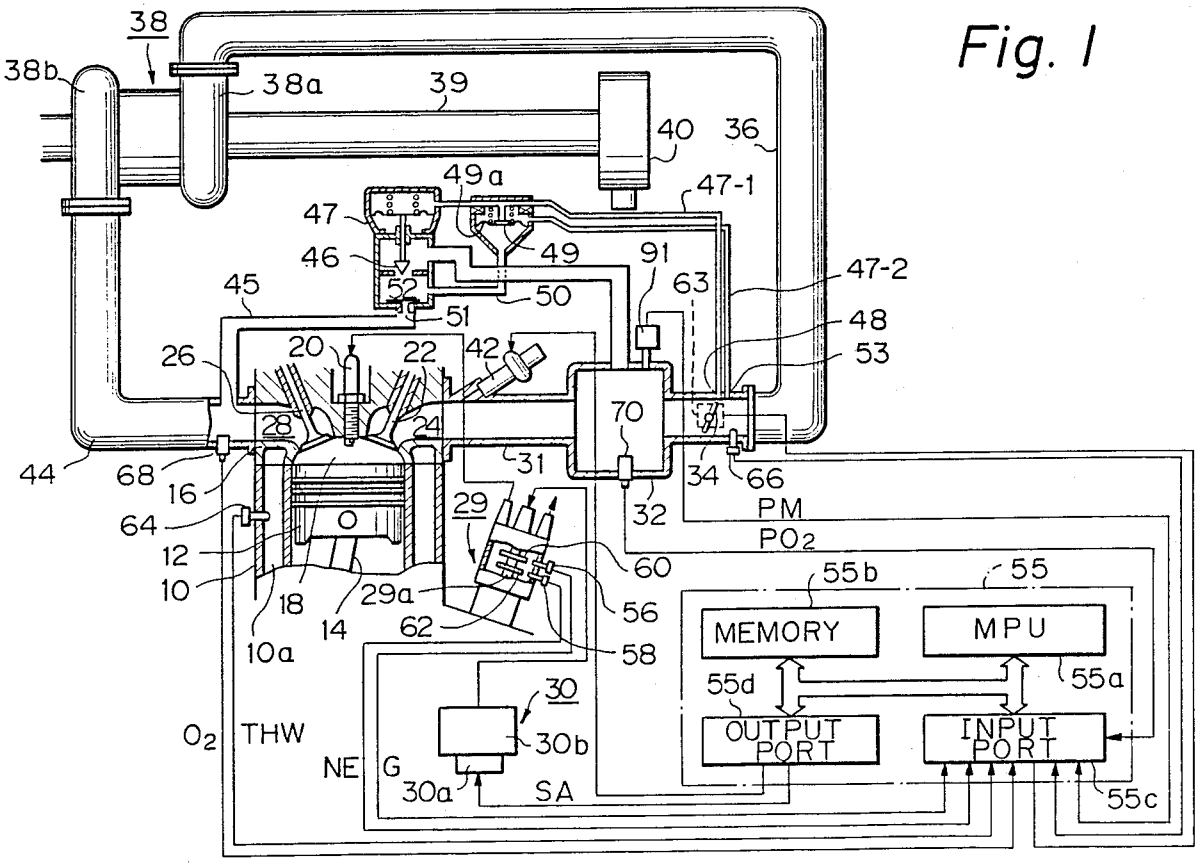
FIG. 1 is a schematic view of an internal combustion engine according to the present invention.

In FIG. 1, 10 denotes a cylinder block, 12 a piston, 14 a connecting rod, 16 a cylinder head, 18 a combustion chamber, 20 a spark plug, 22 an intake valve, 24 an intake port, 26 an exhaust valve, 29 a distributor, and 30 an ignition device. The ignition device 30 comprises an igniter 30*a* and an ignition coil 30*b*. The intake port 24 is connected, via an intake pipe 31, surge tank 32, throttle valve 34, intake pipe 36, and a compressor housing 38*a* of a turbocharger 38, to an air cleaner 40. A fuel injector 42 is arranged in the intake pipe 31 adjacent to the intake port 24. The exhaust port 28 is connected, via an exhaust manifold 44, to a turbine housing 38*b* of the turbo-charger 38. It should be noted that the present invention may be applied to a system wherein a mechanically operated super-charger is employed instead of the turbo-charger 38.

Reference numeral 45 designates an exhaust gas recirculation (EGR) passageway connecting the exhaust manifold 44 to the surge tank 32. An EGR valve 46 is located in the EGR passageway 45 for controlling a ratio of the amount of exhaust gas re-circulated to the total amount of gas introduced into the engine. This is usually known as the EGR ratio. In this embodiment, the EGR valve 46 is provided with a vacuum actuator 47 which is connected, via a vacuum passageway 47-1, to a vacuum taking out port (EGR port) 48 located slightly upstream of the throttle valve 34 when in the idling position. The EGR passageway 45 is provided with an orifice 51 at a position upstream of the EGR valve 46 in the direction of the flow of the exhaust gas. A constant pressure chamber 52 is formed between the EGR valve 46 and the orifice 51. Reference numeral 49 denotes a pressure control valve having a diaphragm 49*a* which is connected to the constant pressure chamber 52 by a pressure passageway 50. The pressure control valve 49 responds to the exhaust gas pressure in the constant pressure chamber 52 and selectively opens the passageway 47-1 to the atmosphere to control the vacuum level in the actuator 47 opened to the EGR port 48, so that the exhaust gas pressure in the chamber 52 is maintained at a substantially constant value, as is well known to those skilled in this art. Furthermore, the diaphragm 49*a* of the pressure control valve 49 is opened, via a passageway 47-2, to a vacuum port 53 located slightly above the EGR port 48, so that a vacuum is applied to the diaphragm 49*a* on one side thereof remote from the other side to which the exhaust gas pressure from the constant pressure chamber 52 is applied. As a result, a control of the EGR ratio in accordance with an engine load is realized. It should be noted that a type of EGR system other than that shown may be employed.

Reference numeral 55 denotes a control circuit constructed as a micro-computer system for obtaining various engine control operations, such as a fuel injection control and ignition control. The control circuit 55 includes a microprocessing unit (MPU) 55*a*, memory 55*b*, input port 55*c*, output port 55*d*, and a bus 55*e* interconnecting these elements. The input port 55*c* is connected to sensors for detecting various engine operating conditions. Crank angle sensors 56 and 58, which are Hall elements, are mounted on the distributor 29. The first crank angle sensor 56 is mounted on the distributor housing and faces a magnet piece 60 on a distributor shaft 29*a*, so that a pulse signal is issued for every 720 degrees rotation of the crankshaft, which corresponds to one complete cycle of the engine. This signal is used as a reference signal. The second crank angle sensor 58 is mounted on the distributor housing and faces a magnet piece 62 on a distributor shaft 29*a* so that a pulse signal is issued for every 30 degrees rotation of the crankshaft. This signal is used to determine an engine speed and to trigger engine operating systems such as the fuel injection and ignition control systems. A throttle sensor 63 is connected to the throttle valve 34 for detecting a degree of opening of the throttle valve 34; an engine water temperature sensor 64 is connected to the cylinder block 10 to detect the temperature THW of the engine cooling water in a water jacket 10*a*; an intake air temperature sensor 66 is mounted to an intake pipe to detect the temperature THA of the intake air introduced into the engine, and, a first (or exhaust side) oxygen sensor 68 is mounted on the exhaust manifold 44 to enable a feedback control of the air-fuel ratio. The exhaust side sensor 68 is an $O_2$ sensor when the air-fuel ratio is to be controlled to a theoretical air-fuel ratio, or is a lean sensor when the air fuel ratio is to be controlled to an air-fuel ratio which is on the lean side with respect to the theoretical air-fuel ratio.

Figure 2:
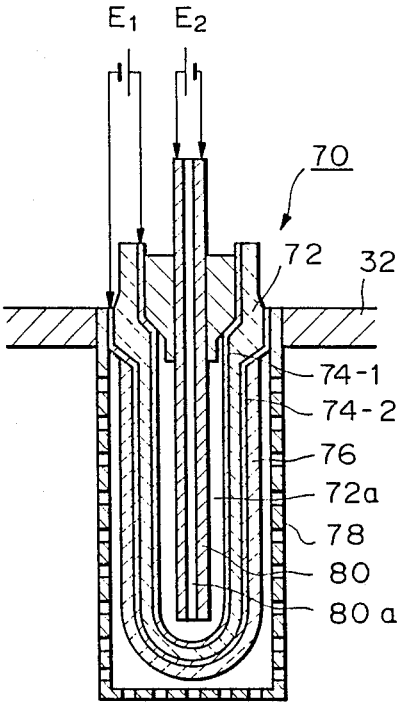
FIG. 2 is a cross-sectional view of an intake side oxygen sensor in FIG. 1.
Figures 3A, 3B:
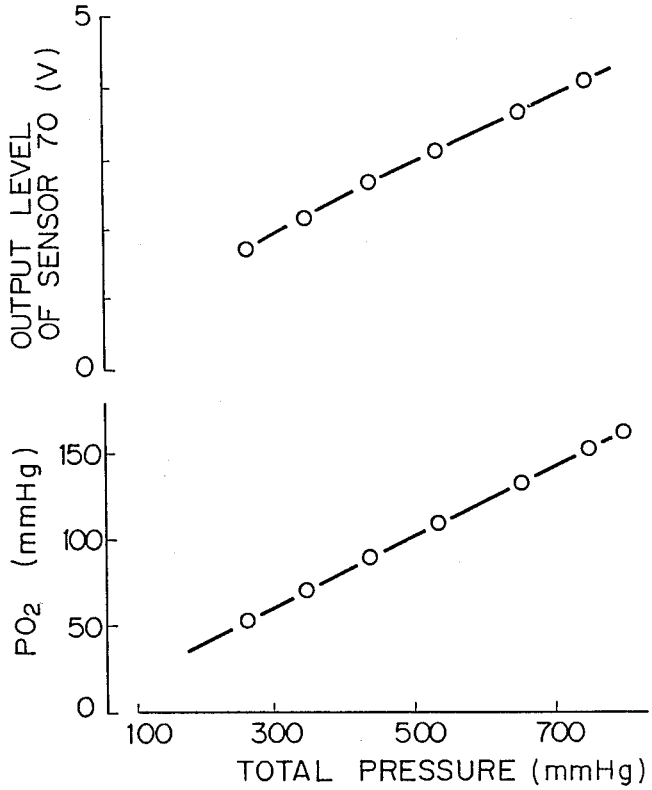
FIGS. 3(*a*) and 3(*b*) show relationships between total pressure and output of the sensor and oxygen pressure, respectively.

According to the first embodiment of the present invention, a second (intake side) oxygen sensor 70 is mounted on the surge tank 32. This second sensor 70 detects the oxygen partial pressure proportional to the amount of air newly introduced into the engine. The detection of the oxygen partial pressure allows the value of the amount of newly introduced air to be detected without being affected by the re-circulated exhaust gas and re-circulated blow-by gas which are introduced into the intake system together with the newly introduced air. The intake side sensor 70 has the same construction as that of the lean sensor. This type of sensor issues an electric signal having a level which changes continuously in accordance with the change in the oxygen partial pressure in the entire gas introduced into the engine. In FIG. 2, the intake side sensor 70 includes, essentially, a tubular member 72 having a closed bottom made of a solid dielectric material such as zirconium, electrodes 74-1 and 74-2 composed of an air permeable film formed on the inside and outside surfaces of the member 72, a perforated diffusion layer 76 formed on the outer electrode 74-2 by a plasma melting deposition of a ceramic material such as spinel, an outer casing 78 formed of a perforated plate, and a tubular shaped ceramic heater 80 arranged in a space 72*a* inside of the tubular member 72. The space 72*a* is opened to the atmosphere via a central passageway 80*a* in the heater 80, and the heater 80 is supplied with electric power from an electric source $E_2$. An electrical source $E_1$ is connected between the inside electrode 74-1 as a positive electrode and the outside electrode 74-2 as a negative electrode. A pumping effect is utilized to cause ionized oxygen $O_2$ in the detected gas to flow from the outside electrode 74-2 to the inside electrode 74-1 at a rate determined by the characteristic of the diffusion layer 76. The resulting ion electric current I, at a certain voltage of the electric source, is expressed as $$I=((4F\times S\times DO_2\times P)/(R\times T\times L))\times(In(1/(1-PO_2/P))),$$

where F is the Faraday constant, S is the area of the electrode, $DO_2$ is the gas diffusion constant, R is the gas constant, T is the temperature, L is the effective length of the diffusion layer, P is the total pressure, and $PO_2$ is the oxygen partial pressure, respectively. FIGS. 3(*a*) and 3(*b*) illustrate, with respect to the total pressure of gas to be detected as designated, the characteristics of the output voltage of the sensor 70, and the oxygen pressure, respectively. As will be understood, a change in the value of the total pressure of the gas to be detected causes a change in the value of the oxygen partial pressure and in the value of the output voltage from the sensor 70, and thus the oxygen pressure can be detected from the sensor output voltage level.

The MPU 55*a* executes calculations in accordance with programs and data stored in the memory 55*b*, to set data in the output port 55*d*. The output port 55*d* is connected to the fuel injectors 42 and other control units to which the control signals from the output port 54*d* are applied.

Figure 4:
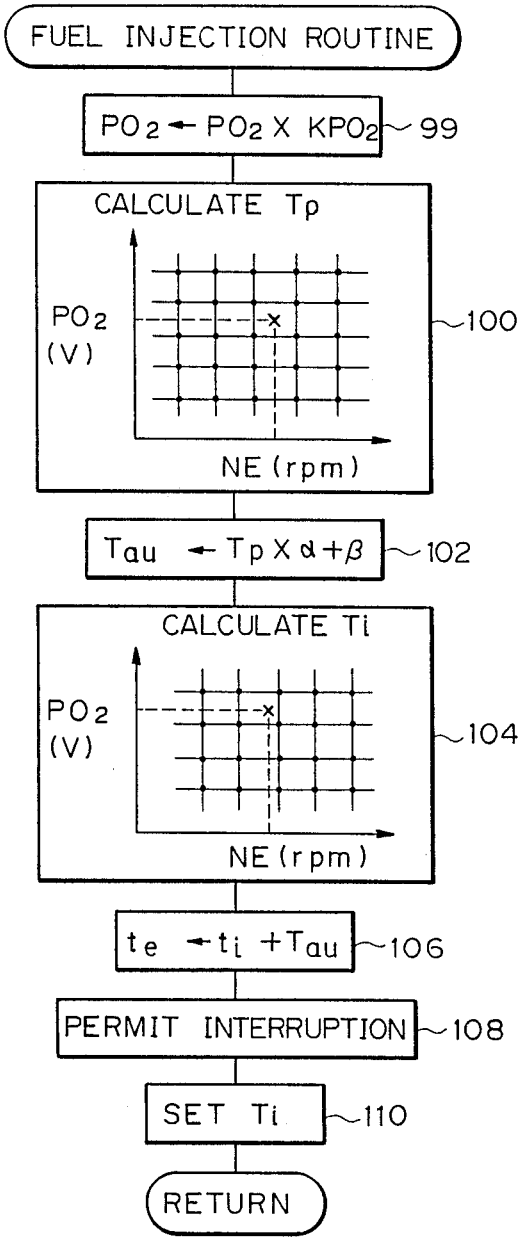
FIGS. 4 to 6 are flowcharts illustrating the fuel injection operations attained in a control circuit in FIG. 1.
Figure 5:
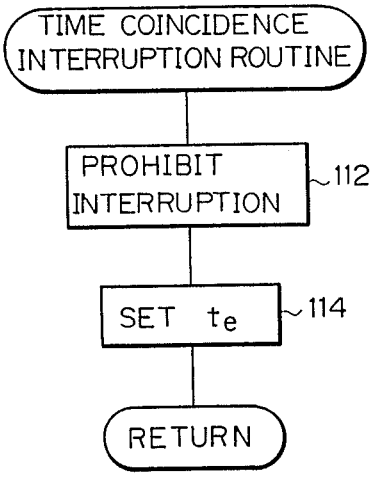

Now, the operation of the control circuit 55 in relation to the fuel injection operation in the first embodiment will be explained with reference to the flowcharts of FIGS. 4 to 6. FIG. 4 explains a fuel injection routine which is commenced by detecting a crank angle before the fuel injection timing of a particular cylinder, for executing a next fuel injection. When the fuel injection is to be executed during the intake cycle, a timing of 60 degrees before top dead center (TDC) during the intake stroke is detected, for example, to commence the fuel injection calculation. This detection is made by a counter which is cleared upon every detection of a 720 degrees CA signal from the first crank angle sensor 56 and is incremented upon detection of every 30 degrees CA signal from the second crank angle sensor 58. At step 99, the corrected value of the output level of the intake side sensor 70 is obtained by multiplying a correction factor $KPO_2$ and $PO_2$. This correction factor is used to compensate changes in the characteristics of the sensor 70 caused by aging, as will fully described later. At step 100, a basic fuel injection period $T_p$ is calculated from the values of the engine speed NE and the output value $PO_2$ of the oxygen sensor 70. This basic fuel injection means corresponds to a period during which an injector 42 is opened to provide an amount of injected fuel with respect to the amount of newly introduced air, to provide a theoretical air-fuel ratio. Since the volumetric efficiency changes as the engine speed changes, the basic fuel injection amount is determined not only by the amount of newly introduced air but also by the engine speed, in order to obtain a correct desired air-fuel ratio irrespective of any change in the volumetric efficiency. In the prior art D-J type air fuel injection system, the amount of newly introduced air is indirectly detected by detecting the intake pressure, and the basic fuel amount is calculated from a combination of the values of the engine speed and the intake pressure. According to this embodiment of the present invention, the basic fuel injection amount value is determined by a combination of the values of the output voltage of $PO_2$ of the intake side oxygen sensor 70 corresponding to the amount of new air and the engine speed. The memory 55*b* is provided with a map of data of a basic fuel injection period Tp, for obtaining a theoretical air-fuel ratio with respect to combinations of the values of the engine rotational speed and the output voltage level $PO_2$ of the oxygen sensor 70. The MPU 55*a* executes a map interpolation calculation from an actual value of the engine speed NE detected by a spacing of adjacent 30 degree CA signals from the second crank angle sensor 58 and an actual value of the output voltage $PO_2$ of the intake side oxygen sensor 70, to obtain a value of the basic fuel injection period.

At step 102, a value of a final injection amount Tau is calculated by $$Tau=Tp\times\alpha+\beta$$

where $\alpha$ and $\beta$ generally designate correction factors indicating various correction processes for correcting the basic fuel injection amount, which include, for example, a feedback correction calculated by the air-fuel ratio calculated by an air-fuel signal from the exhaust side sensor 68, a water temperature correction calculated by a water temperature signal from the temperature sensor 64, an air temperature correction by the atmospheric air temperature sensor 66, and an acceleration enrichment correction. These factors are not explained in detail, since they are not directly related to this invention.

Figure 7:
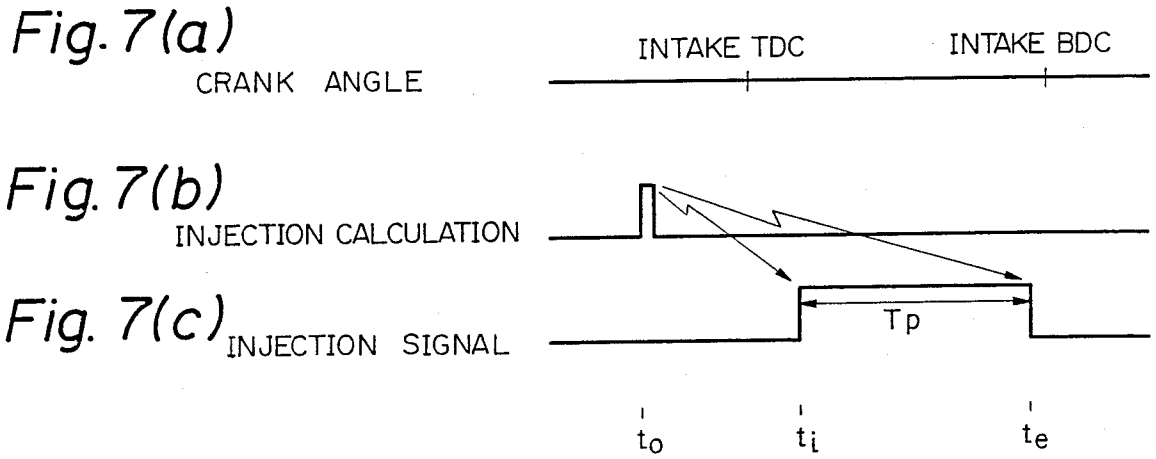
FIGS. 7(*a*), 7(*b*) and 7(*c*) are timing charts illustrating the fuel injection operation of the control circuit in FIG. 1.

At step 104, a timing $t_i$ for starting the fuel injection is calculated. The timing $t_i$ is determined in accordance with the engine operating characteristics in such a manner that, for example, the completion of the fuel injection is substantially synchronous with the timing of the completion of the intake stroke. This means that the timing for starting the fuel injection should be varied in accordance with the amount of new air and the engine speed. The memory 55*b* is provided with a map of data of the timing for starting a fuel injection as crank angle values from the top dead center in the intake stroke with respect to combinations of the values of the output level $PO_2$ and the engine speed. The MPU 55*a* executes a map interpolation calculation for obtaining a time $t_i$ from the present time $t_0$, from the actual value of the output level $PO_2$ of the intake side sensor 70 and the actual engine speed NE as a spacing between adjacent pulse signals from the second crank angle sensor 58. FIGS. 7(*a*), (*b*) and (*c*) explain the details of the fuel injection signal.

At step 106, a time $t_e$ for finishing the fuel injection is calculated by adding the fuel injection starting time $t_i$ to the fuel injection period Tau calculated at step 102. At step 108, a time coincidence interruption is allowed, and at step 110, the time $t_i$ for starting the fuel injection is set to a comparator (not shown) for controlling the fuel injection.

When the present time coincides with the set time $t_i$, a signal is sent to open the injector 42 and start the fuel injection. At the same time, a time coincidence interruption routine in FIG. 5 is commenced. At step 112, the time coincidence interruption routine is prohibited, and at step 114, the time $t_e$ is set to the comparator. Therefore, when the present time coincides with the set time $t_e$, the fuel injection by the injector 42 is stopped.

Figure 6:
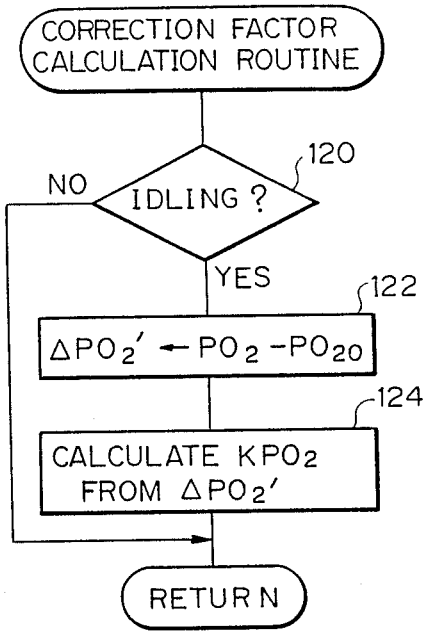
Figure 8:
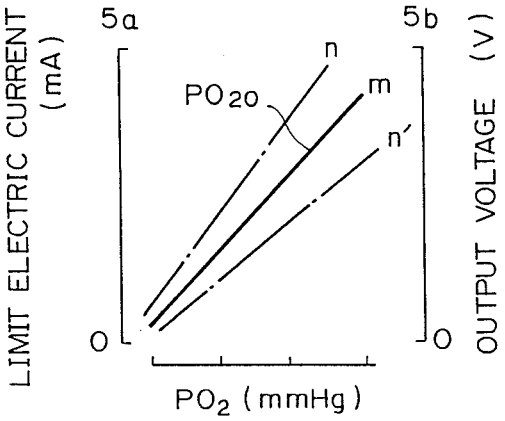
FIG. 8 shows the relationship between the partial pressure of oxygen and a limited electric current.
Figure 9:
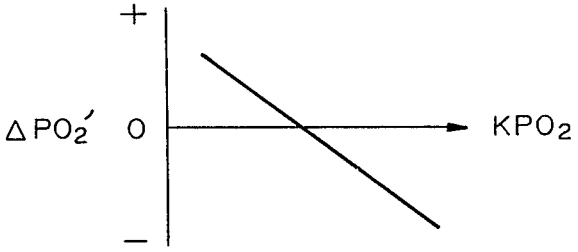
FIG. 9 shows the relationship between the correction factor $KPO_2$ and the deviation $\Delta PO_2$ of the actual partial pressure value from the calculated partial pressure value.

FIG. 6 shows a routine for compensating the output level of the intake side sensor 70. This routine can be carried out independently or can be integrated into the routine in FIG. 4. FIG. 8 shows the relationships between the amount of new air (oxygen partial pressure) $PO_2$ and the limit electric current. When the sensor is in the normal state, the characteristic is shown by a line m. Individual differences or a time difference cause the characteristic to deviate from the reference line m. The line n shows a characteristic providing a higher output level than the reference sensor, and shows a characteristic providing a lower output level than the reference value. The routine in FIG. 6 is used for compensating these changes in the output characteristic, to obtain a precise control of the air-fuel ratio. At step 120 it is determined if the engine is in, for example, an idling condition, where only new air is introduced, i.e., no introduction of the exhaust gas or blow-by gas other than the new air is carried out. The idling condition is detected by a combination of a throttle valve in the idling position and an engine speed at an idling speed. When the engine is under the idling condition, the routine goes to step 122 where a difference between the actual output level $PO_2$ of the intake side sensor 70 and the fixed reference value $PO_{20}$ is moved to $\Delta PO_2'$. This difference value $\Delta PO_2'$ corresponds to a deviation of the output value of the sensor 70, now being used, from that of the reference sensor. The value of $\Delta PO_2'$ is obtained from the reference curve m in FIG. 8 when the engine is in the idling condition, and is stored in the memory. At step 124, the correction factor $KPO_2$ is calculated from the value of $\Delta PO_2'$. This correction factor $KPO_2$ is multiplied by the actual value of the sensor 70 as realized by step 99 of FIG. 4, which brings the deviated characteristic n or n' back to the normal characteristic as shown by the line m. The relationship between the value of the difference $\Delta PO_2'$ and the correction factor $KPO_2$ is shown by FIG. 9. This relationship is stored in the memory 55*b* as a map, and a map interpolation calculation is carried out to obtain a value of the correction factor $KPO_2$ corresponding to the value of $\Delta PO_2'$ calculated at step 122.

The above embodiments are described with reference to an EGR system, but the present invention can be applied to a system other than the EGR system. An advantage of application of this invention to an engine using the EGR system is that the fuel injection system is, per se, simplified, because there is no need to provide the system with a means for correcting the fuel amount in accordance with the EGR ratio. In a normal type D-J system, the basic fuel injection amount is determined by a combination of the values of the intake pressure and the engine speed. When the EGR operation is carried out, the intake pressure sensor detects a total amount of gas including not only the new air but also the exhaust gas, which means that the amount of new air is smaller than the value as detected, and this necessitates a reduction in the actual amount of fuel to be injected from that calculated. Contrary to this, according to the above-mentioned embodiment, the intake side sensor can detect only the amount of new air, like an air flow meter in the conventional L-J system, even if an EGR operation is carried out, and thus an EGR correction of the fuel injection amount is not necessary.

Although the above embodiment is directed to an application of the present invention to a fuel injection system, the present invention can be also applied to an ignition control system. In this case, a basic ignition timing is calculated by a combination of values of the oxygen partial pressure $PO_2$ and the engine speed. The basic ignition timing is, as well known to those skilled in this art, a value of an ignition timing for obtaining the maximum torque at a fixed amount of air when the engine speed is fixed.

The above mentioned first embodiment is directed to a "new" D-J system incorporating improvements by the inventors whereby the amount of new air is detected by the intake side sensor 70 as an oxygen density sensor responsive to the oxygen partial pressure in the total amount of gas introduced into the engine. The present invention, however, can be also applied to a usual type of D-J system where the amount of new air is detected by an intake pressure sensor and the calculated basic fuel injection amount is corrected by the oxygen partial pressure $PO_2$, as will be described below as a second embodiment of the present invention. This second embodiment differs from the first embodiment in structure, in that an intake pressure sensor 91 is connected to the surge tank 32 for providing a signal indicating an intake pressure of the intake line of the engine.

Figure 10:
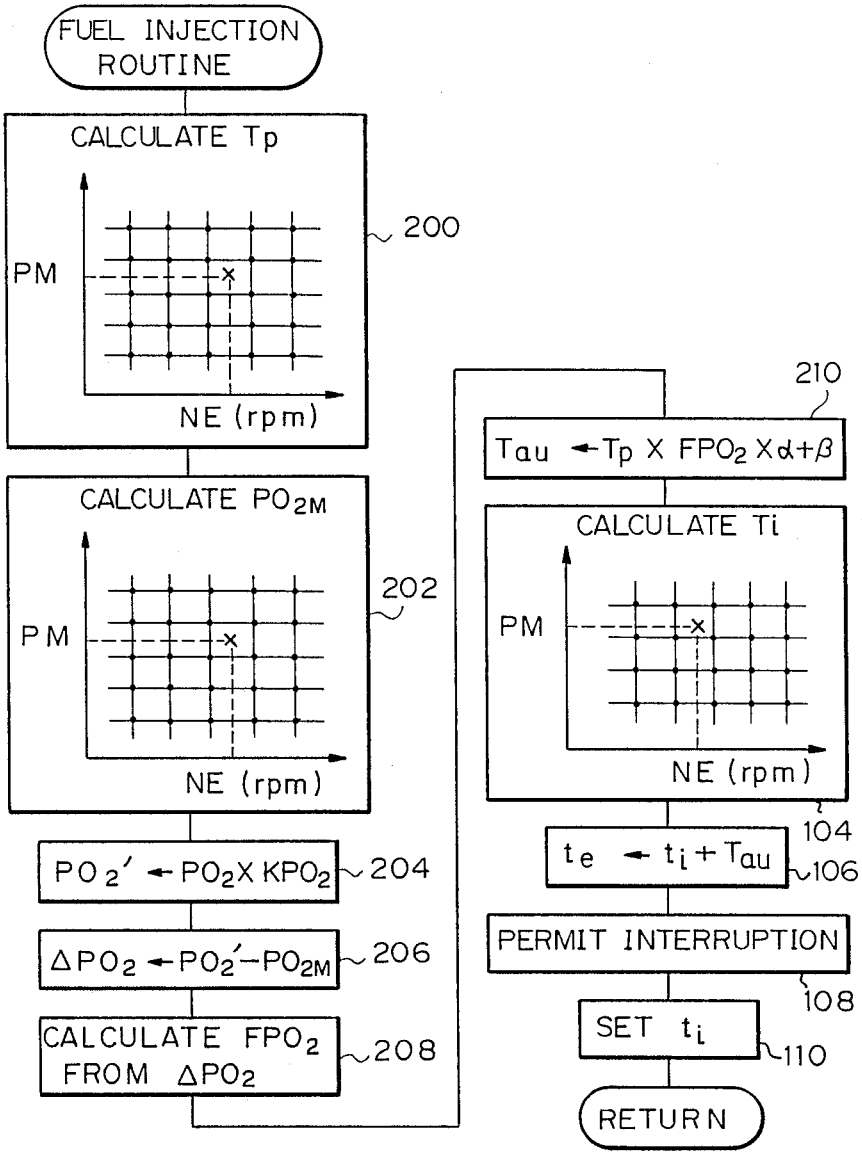
FIG. 10 is a flowchart illustrating the injection control operation in the second embodiment of the present invention; and, FIG. 11 shows the relationship between the correction factor $FPO_2$ and the deviation $\Delta PO_2$ of the actual partial pressure value from the calculated partial pressure value.

Now, the operation of the control circuit 55 in relation to the fuel injection in the second embodiment will be explained with reference to the flowcharts. FIG. 10 shows a fuel injection routine which corresponds to the routine in FIG. 4 in the first embodiment. At step 200, a basic fuel injection period Tp is calculated from the engine speed NE and intake pressure PM. The memory 55*b* is provided with a map of data of the basic fuel injection period Tp, for obtaining a theoretical air-fuel ratio with respect to combinations of the values of the engine rotational speed and the intake pressure. The MPU 55*a* executes a map interpolation calculation from an actual value of the engine speed NE and actual value of the intake pressure PM sensed by the pressure sensor 91, to obtain a value of the basic fuel injection period.

At step 202, a calculation of a target value of the oxygen pressure $PO_{2M}$ is carried out using the intake pressure PM and the engine speed NE. The value of the oxygen partial pressure is determined by the intake pressure PM and the engine speed NE under a condition wherein only new air is introduced into the engine without accompanying EGR gas. The memory 55*b* is provided with a map of data of the oxygen pressure $PO_{2M}$ with respect to combinations of the values of the intake pressure PM and the engine speed NE. A map interpolation calculation is carried out to obtain a value of the oxygen pressure $PO_{2M}$ corresponding to a combination of the actual values of the intake pressure and the engine speed.

Figure 11:
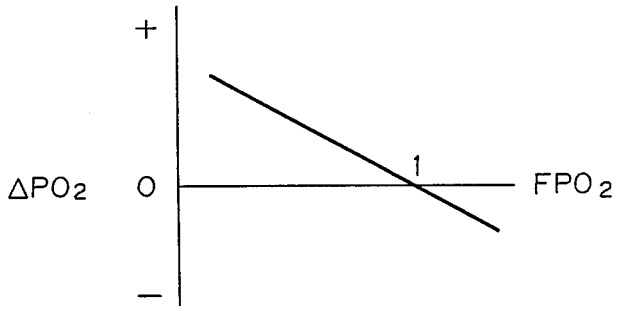

At step 204, a value of the oxygen partial pressure $PO_2'$ as compensated is, similarly to step 99 in the first embodiment, calculated from the detected oxygen pressure value $PO_2$ multiplied by the correction factor $KPO_2$, which is calculated by the same routine as of FIG. 6 in the first embodiment of the present invention. At step 206, a difference $\Delta PO_2$ between the value of the corrected oxygen pressure $PO_2'$ calculated at step 204 and the map value of the oxygen pressure $PO_{2M}$ is determined. This difference value $\Delta PO_2$ corresponds to the amount of total gas introduced into the engine, including the EGR gas and blow-by gas, other than the new air introduced. At step 208, a correction factor $FPO_2$ is calculated for correcting the injected fuel amount in accordance with a gas amount other than the new air, and the air-fuel ratio is maintained regardless of the latter amount. FIG. 11 shows the relationship between $\Delta PO_2$ and $FPO_2$. This relationship is stored in the memory 55*a*, and a map interpolation calculation is carried out to obtain a value of the correction factor $FPO_2$ corresponding to the calculated value of $\Delta PO_2$. The steps following 104 are the same as those in FIG. 4 in the first embodiment.

At step 210, a final fuel injection amount Tau is calculated by multiplying the correction factor $TOTP_2$ with the basic fuel amount TP; that is $$Tau = Tp \times FOTP_2 \times \alpha + \beta$$

Namely, the basic fuel injection amount is corrected by the factor $FOTP_2$ so that the basic fuel injection amount corresponds to the deviation of the calculated new air amount $PO_2$ from the actual new air amount $PO_2$.

Although the present invention is described with reference to preferred embodiments, it is obvious that many modifications and changes can be made by those skilled in this art.

We claim:

1. An internal combustion engine comprising:

an engine body;

an intake system connected to the engine body for introducing air thereto, the system including a throttle valve for controlling the amount of air introduced;

an exhaust system connected to the engine body for removing resultant Combustion gas therefrom;

further comprising passageway means for connecting the exhaust system and the intake system for recirculating an amount of exhaust gas from the exhaust system to the intake system;

first sensor means arranged in the intake system at a position downstream of the throttle valve for detecting intake pressure;

calculating means for calculating, from the detected intake pressure, a basic value of an engine characteristic concerning an amount of new air introduced into the engine for obtaining a predetermined value of said engine characteristic as desired;

second sensor means arranged in the intake system at a position downstream of the throttle valve, said sensor providing an electrical signal indicating the partial pressure of oxygen in the introduced air;

correcting means, responsive to the sensed value of partial pressure of oxygen in the introduced air, for obtaining a corrected basic value of said engine operational characteristic to attain a precise control of the engine characteristic to the desired value; and control means for controlling the engine operational characteristic to obtain the corrected engine operating characteristic value, wherein said correcting means comprises a map means for storing values of an oxygen pressure in accordance with values of an intake pressure, means for interpolating, from the map, a value of the oxygen partial pressure corresponding to the sensed oxygen partial pressure, and means for correcting the basic characteristic value from the difference between the detected oxygen partial pressure and the interpolated oxygen pressure.

2. An internal combustion engine comprising:

an engine body;

an intake system connected to the engine body for introducing air thereto, the system including a throttle valve for controlling the amount of air introduced;

an exhaust system connected to the engine body for removing resultant combustion gas therefrom;

passageway means for connecting the exhaust system and the intake system for recirculating an amount of exhaust gas from the exhaust system to the intake system;

first sensor means arranged in the intake system at a position downstream of the throttle valve for detecting intake pressure;

calculating means for calculating, from the detected intake pressure, a basic value of an engine characteristic concerning an amount of new air introduced into the engine for obtaining a predetermined value of said engine characteristic as desired;

second sensor means arranged in the intake system at a position downstream of the throttle valve, said sensor providing an electric signal indicating the partial pressure of oxygen in the introduced air;

first correcting means, responsive to the sensed value of partial pressure of oxygen in the introduced air, for obtaining a corrected basic value of said engine operational characteristic to attain a precise control of the engine characteristic to the desired value;

second correcting means for correcting the sensitivity of the second sensor means; and control means for controlling the engine operational characteristic to obtain the corrected engine operating characteristic value, wherein said second correcting means comprises means for judging a particular engine condition in which no gas other than new air is introduced, means for obtaining a reference value of the oxygen partial pressure, and means for correcting the basic characteristic value in accordance with a deviation of the actual value of the oxygen partial pressure detected by said sensor means from said reference value.

3. An internal combustion engine comprising:

an engine body;

an intake system connected to the engine body for introducing air thereto, the system including a throttle valve for controlling the amount of air introduced;

an exhaust system connected to the engine body for removing resultant combustion gas therefrom;

passageway means for connecting the exhaust system and the intake system for recirculating an amount of exhaust gas from the exhaust system to the intake system;

first sensor means arranged in the intake system at a position downstream of the throttle valve for detecting intake pressure;

first calculating means for calculating, from the detected intake pressure, a basic value of an engine characteristic concerning an amount of new air introduced into the engine for obtaining a predetermined value of said engine characteristic as desired;

second sensor means arranged in the intake system at a position downstream of the throttle valve, said sensor providing an electric signal indicating the partial pressure of oxygen in the introduced air;

second calculating means for calculating a target value of a partial pressure of oxygen from the value of the intake pressure detected by the first sensor means;

means for comparing the value of the partial pressure of the oxygen detected by the second sensor means with the target value of the partial pressure of the oxygen calculated by the second calculating means and issuing a signal indicating a correction of the basic characteristic value;

correcting means, responsive to the outputs of the first calculating means and the comparing means for obtaining a corrected basic value of said engine operational characteristic to attain a precise control of the engine characteristic to the desired value; and control means for controlling the engine operational characteristic in response to the correcting means to obtain the corrected engine operating characteristic value.

4. An internal combustion engine according to claim 3, wherein said first calculating means comprises map means for storing basic values of an engine characteristic in accordance with values of an intake pressure, and interpolating means for obtaining a value of the engine characteristic matching the detected intake pressure.

5. An internal combustion engine according to claim 3, further comprising second correcting means for correcting the sensitivity of the second sensor means.

6. An internal combustion engine according to claim 3, wherein said particular engine condition is an engine idling condition.

7. An internal combustion engine according to claim 3, wherein said operational characteristic is an amount of fuel introduced into the engine to obtain a desired air-fuel ratio.

8. An internal combustion engine according to claim 3, wherein said second sensor means comprises a limit current type oxygen sensor having a diffusion member made of a ceramic material, a first electrode on one side of the member and exposed to introduced gas in the intake system, and a second electrode on the other side of the member and exposed to a reference air, an ionic current being formed in the diffusion material at a continuously varied level corresponding to the oxygen density detected in the gas.

* * * * *